US009046298B2

(12) United States Patent
Laible et al.

(10) Patent No.: US 9,046,298 B2
(45) Date of Patent: Jun. 2, 2015

(54) DOMESTIC APPLIANCE FOR INSTALLATION IN A FURNITURE FRAME

(75) Inventors: Karl-Friedrich Laible, Langenau (DE); Hans-Philipp Reitz, Giengen (DE); Helmut Steichele, Lauingen (DE)

(73) Assignee: BSH Bosch und Siemens Hausgeräte GmbH, Munich (DE)

( * ) Notice: Subject to any disclaimer, the term of this patent is extended or adjusted under 35 U.S.C. 154(b) by 1290 days.

(21) Appl. No.: 12/498,404

(22) Filed: Jul. 7, 2009

(65) Prior Publication Data

US 2010/0045150 A1 Feb. 25, 2010

(30) Foreign Application Priority Data

Aug. 22, 2008 (DE) ..... 10 2008 041 487

(51) Int. Cl.
*A47B 96/04* (2006.01)
*F25D 23/10* (2006.01)
*F24C 15/30* (2006.01)

(52) U.S. Cl.
CPC ..... *F25D 23/10* (2013.01); *F24C 15/30* (2013.01)

(58) Field of Classification Search
CPC ..... F25D 23/10; F24C 15/30
USPC ..... 312/237, 297, 204, 405, 401, 265.5, 312/107, 109, 111, 242, 198, 199; 29/557; 403/263, 353
See application file for complete search history.

(56) References Cited

U.S. PATENT DOCUMENTS 1,657,049 A * 1/1928 Sicklen, Jr. ..... 224/543
1,743,273 A * 1/1930 Hammer ..... 312/242
1,748,234 A * 2/1930 Loeb ..... 220/3.4
2,649,142 A * 8/1953 New ..... 297/395
2,771,687 A * 11/1956 Hutto, Jr. ..... 33/501.45
2,832,080 A * 4/1958 Hertenstein et al. ..... 4/670
2,881,482 A * 4/1959 Hiers ..... 49/399
3,051,160 A * 8/1962 Nielsen ..... 126/37 R
3,055,468 A * 9/1962 Horejs et al. ..... 52/393
3,238,686 A * 3/1966 Pomeroy ..... 52/511
3,376,861 A * 4/1968 Bach, Jr. ..... 126/37 R
3,473,858 A * 10/1969 Barnett ..... 312/111
3,501,186 A * 3/1970 Wilcox et al. ..... 52/718.05
3,516,637 A * 6/1970 Lawson et al. ..... 248/477
3,594,254 A * 7/1971 Lemelson ..... 156/384
4,015,760 A * 4/1977 Bott ..... 224/324
4,312,165 A * 1/1982 Mizusawa ..... 52/511
4,370,007 A * 1/1983 Fler ..... 312/334.11
4,948,206 A * 8/1990 Fitzpatrick ..... 312/296
4,970,874 A * 11/1990 Solak et al. ..... 62/258
5,564,808 A * 10/1996 Gipson et al. ..... 312/405
5,624,170 A * 4/1997 Hasty ..... 312/329
5,752,356 A * 5/1998 Miklavic et al. ..... 52/718.02
6,460,219 B2 * 10/2002 Domenig et al. ..... 16/240
6,955,019 B2 * 10/2005 Donlin et al. ..... 52/520
6,997,530 B2 * 2/2006 Avendano et al. ..... 312/401
7,293,847 B2 * 11/2007 Lee et al. ..... 312/406.2
2008/0120912 A1 * 5/2008 Crompton et al. ..... 49/372

* cited by examiner

*Primary Examiner* — Daniel J Troy
*Assistant Examiner* — Timothy M Ayres
(74) *Attorney, Agent, or Firm* — Nixon & Vanderhye P.C.

(57) ABSTRACT

A domestic appliance for installation in a furniture frame. The appliance includes an essentially rectangular body and a vertical cover section fixed to a front vertical edge of the body and extending laterally beyond the vertical edge onto the furniture frame. A leg of the section adjacent to a lateral wall of the body has a hole for a fixing screw and a head of the fixing screw is accommodated at least partially in a depression surrounding the hole. A floor of a depression surrounding the hole is level, and a shaft of the fixing screw maintains clearance as it passes through the hole.

20 Claims, 2 Drawing Sheets

Fig. 2
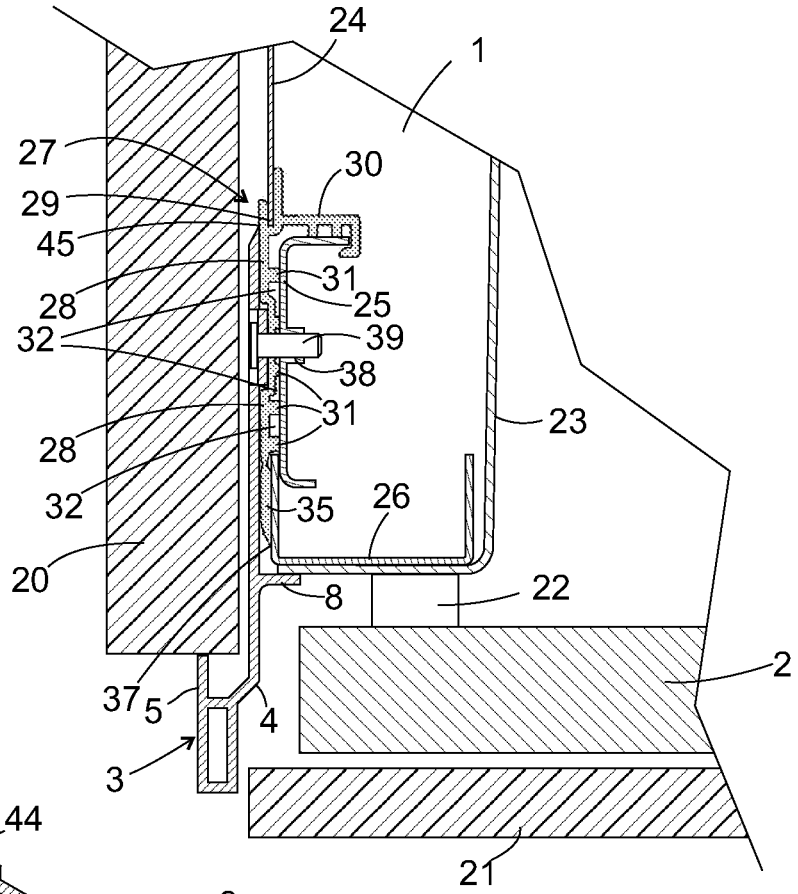
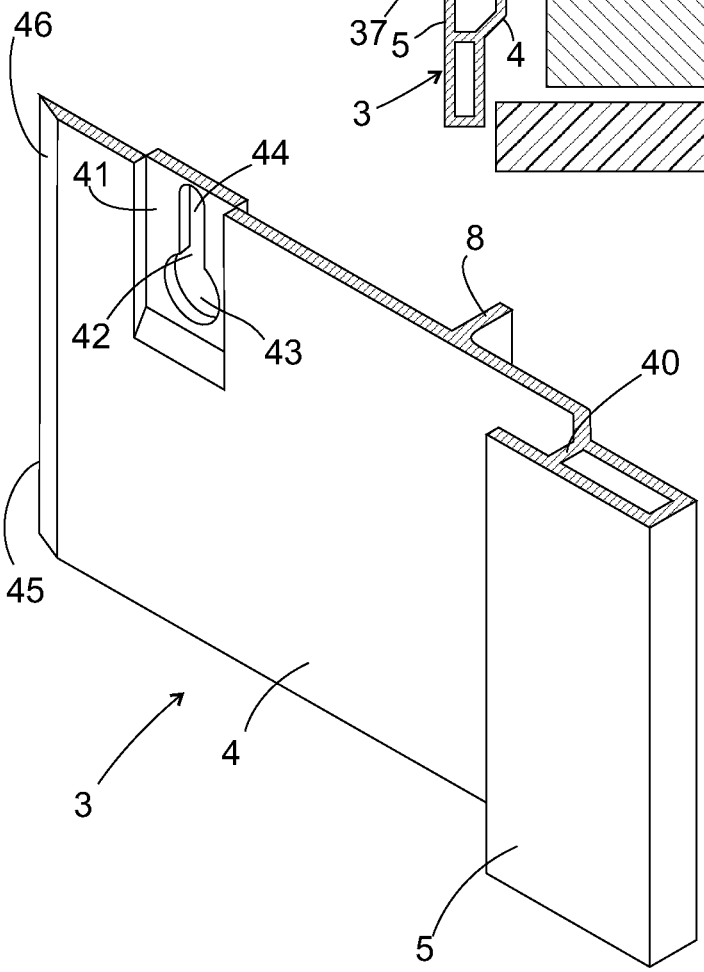
Fig. 4

DOMESTIC APPLIANCE FOR INSTALLATION IN A FURNITURE FRAME

This application claims priority to German Application No. 102008041487.5, filed Aug. 22, 2008, the entire contents is hereby incorporated by reference.

BACKGROUND OF THE INVENTION

This present invention relates to a domestic appliance for installation in a furniture frame that has an essentially rectangular body and two cover sections which are fixed to the front vertical edges of the body and extend laterally beyond the vertical edges onto the furniture frame. The cover sections conceal a gap between the body and the furniture frame surrounding it and thus hide irregularities in form and/or dimensions of the appliance body or of the furniture frame, such as may occur in particular with refrigerators with foam-packed housings.

Domestic appliances with vertical cover sections fixed to the body and protruding beyond the sides and possibly with a horizontal cover section fastened to a front upper edge of the body are particularly widespread on the US market.

BRIEF SUMMARY OF THE INVENTION

If vertical cover sections are screwed to the sides of the body of the domestic appliance before installation in a furniture niche, this presents the problem that screw heads protruding from the sides increase the width of the appliance and could damage the furniture niche if they rub against it when the appliance is being pushed into the niche. To avoid this problem it is known for the cover section to be affixed using countersunk head screws, the heads of which disappear into corresponding holes in the cover sections so that they do not touch the furniture frame and also cannot cause any damage. The countersunk holes predefine the exact position of the cover section on the appliance body; therefore it is not possible to correct the height of the cover sections subsequently to compensate for inaccuracies in the positioning of the screw holes in the cover section or the corresponding threaded holes on different sides of the appliance body. Differences in height between the cover sections on opposite sides of the body look particularly unattractive when a horizontal cover section extends between the vertical cover sections.

An object of the invention is to develop a domestic appliance of the type described above so that any risk to the furniture frame when the appliance is pushed in is avoided as far as possible and it remains possible to compensate for tolerances when the cover section is attached.

This object is achieved wherein, in a domestic appliance for installation in a furniture frame with an essentially rectangular body and two vertical cover sections which are fixed to the front vertical edges of the body and extend laterally beyond the vertical edges onto the furniture frame, wherein a leg of a section adjacent to a lateral wall of the body has a hole for a fixing screw and a head of the fixing screw is accommodated at least partially in a depression surrounding the hole, which is level with the floor of the depression surrounding the hole, and with a shaft of the fixing screw maintaining clearance as it passes through the hole.

The head of the fixing screw is preferably completely accommodated in the depression in order to prevent any contact between the furniture frame and the screw head when the appliance is pushed in.

The hole is preferably extended vertically to enable the position of the cover section to be adjusted vertically.

It is further preferable that the hole incorporates a wide section through which the head of the fixing screw passes, and a narrow section through which the head does not pass. It is thus possible initially to affix one or more screws to the body of the domestic appliance and to hang the cover section onto these screws before its vertical position is fixed by tightening the screw (or screws).

On the leg a section adjacent to the lateral wall, a surface running downward of the body 1 and backward onto the lateral wall of the body is preferably formed between the depression accommodating the screw head and a rearward edge of the leg. This sloping surface may come into contact with the furniture frame when the appliance is pushed into the furniture niche without damaging it and may center the body when it is pushed into the niche.

The cover section preferably has a rib adjacent to the front surface of the body which is used firstly as a stop for the positioning of the cover section downward, and secondly may also conceal any gap between the cover section and the lateral wall of the body. Slight unevenness of the lateral wall of the body that may occur with foam packing thus remains inconspicuous.

To ensure that no condensed water falls onto the metallic cover section during operation, the metallic cover section is preferably thermally insulated from a metallic bearing structure of the body by a plastic profile element.

To improve the insulating effect of the plastic profile element it is useful for the plastic profile element to have a base plate and ribs protruding from the base plate toward the bearing structure or toward the cover section. Cavities delimited by these ribs improve the insulation capacity particularly if they remain empty or are filled with the same insulating material as other areas of the appliance housing.

It is further preferable for each recess on an outer surface of the cover section to have a projection on the opposite inner surface of the same. Thus the projections of the cover section can easily be formed by stamping. The projections can effectively be located in a groove of the plastic profile element.

The plastic profile element may be manufactured by extrusion, in exactly the same way as a preliminary stage of the cover section in which the projections are then formed.

The plastic profile element is preferably a component of the body. In particular it may have a groove into which a fixed outer shell of the body is pushed. In particular, in order to absorb the pressure exerted on the outer shell if the body is foam-packed, it is useful for a hook from the plastic profile element to encompass the support structure.

BRIEF DESCRIPTION OF THE DRAWINGS

Further features and advantages of the invention are revealed in the following description of exemplary embodiments with reference to the attached diagrams, in which;

FIG. 2 shows a horizontal detailed section through the refrigerator and a furniture niche to accommodate it;

FIG. 4 shows a perspective view of the cover section.

DETAILED DESCRIPTION OF THE PRESENT INVENTION

Figure 1:
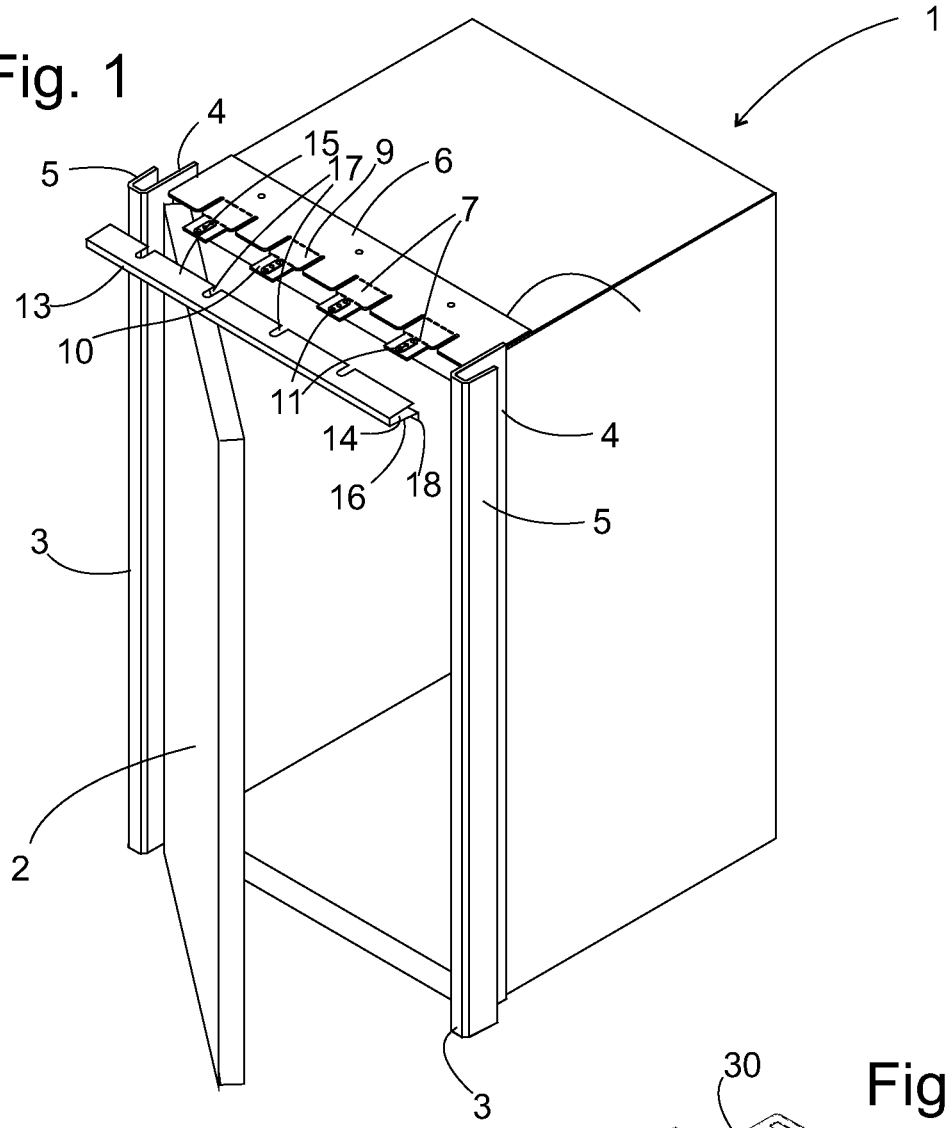
FIG. 1 shows a perspective view of a refrigerator according to the invention.

A door 2 is fixed at the front of the rectangular body of the refrigerator shown in FIG. 1. On the front edges of the lateral walls of the body 1, two U-shaped cover sections 3 are attached symmetrically in relation to one another, with one leg 4 of each U shape 3, which touches the lateral wall of the body 1 and is screwed to it, being longer than the opposite leg 5 which faces away from the lateral wall. Since the backward edges of the outer leg 5 push against the front surface of one of the mobile frames surrounding the niche when the body 1 is placed in a furniture niche, they conceal a gap between it and the body 1.

An adapter plate 6 made of sheet metal is screwed to the upper surface of the body 1. On the front edge of the adapter plate 6 a plurality of brackets 7 are cut free. Each of the brackets 7 projects beyond the front surface of the body 1 but not beyond the front edges of the vertical cover sections 3. The brackets 7 each have two flexible weak points, which are formed by a number of slots stamped along a line. One of these weak points delimits the bracket 7 from the main part of the adapter plate 6; the other subdivides the bracket 7 into a headpiece 9 and a connecting piece 10.

A projection 11 extending downward is stamped into each headpiece 9, and several downward graduated screw holes are formed in the projection 11.

A horizontal cover section 13, which is provided for attaching to the brackets 7 of the body 1 mounted in a furniture niche, is shown in FIG. 1 separated from the body 1. This horizontal cover section 13 has an essentially U-shaped cross-section with essentially horizontally oriented legs 15, 16, which form the boundary of a groove 14 facing toward the brackets 7. The upper leg 15 is provided with several equally spaced slots 17 which are open at the edge. The lower leg 16 has a downward angled plate 18 on its rearward edge.

When the body 1 is placed in a furniture niche so that the leg 5 of the vertical cover sections 3 is adjacent to the front edge of a frame of a furniture niche, then the brackets 7 should be turned upward by an installation engineer so that the projections 11 of their head pieces 9 come to rest on a horizontal upper section of the frame. After the headpieces 9 are screwed firmly to the horizontal upper frame section the horizontal cover section 13 is affixed from the front, wherein its upper leg 15 is inserted between the headpiece 9 and the horizontal frame section and the projections 11 come to rest in the slots 17. A stop position of the horizontal cover section 13 is defined by the contact of the plate 18 with the front surface of the body 1.

FIG. 2 shows an enlarged horizontal section through a corner of the refrigerator body 1 and an adjacent lateral wall 20 of the furniture niche. The door 2, a furniture plate 21 affixed to it, and a magnetic seal 22 are illustrated largely schematically. The construction of the lateral wall of the body 1 is shown in greater detail. In a manner known per se, a one-piece deep-drawn plastic inner container 23 forms an inner shell to the lateral wall. An outer shell 24 of the lateral wall may consist of plastic, sheet metal, fiberboard or suchlike. Two U-profiles 25, 26 made from metal extend beyond the total height of the body and give the lateral wall the necessary rigidity. The outer shell 24 is connected to the lateral U-profile 25 via an extruded plastic profile element 27. The profile element 27 comprises a base plate 28, which extends the outer shell 24 forward, a groove 29 into which the front edge of the outer shell 24 is inserted, and a hook 30 which encompasses the U-profile 25, in order to maintain the outer shell 24 in position if the cavity between the inner and outer shell 23, 24 is foam-packed, and to make it more rigid vertically. Several flat ribs 31 protruding from the base plate 28 touch the U-profile 25 and delimit air-filled channels 32, which thermally insulate the base plate 28 opposite the U-profile 25.

Figure 3:
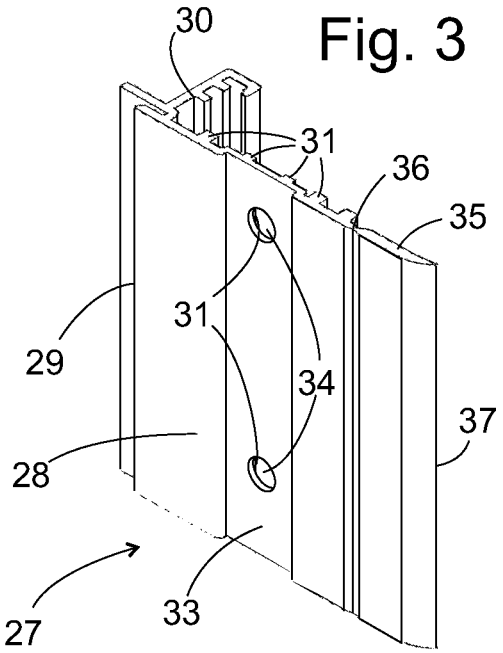
FIG. 3 shows a perspective view of the plastic profile element.

FIG. 3 shows a perspective view of a section through the profile element 27. A flat groove 33 is formed in the base plate 28 on the outer surface of the profile element 27 facing away from the U-profile 25. Holes 34 are drilled at regular intervals in the floor of the groove 33. On the inner surface of the profile element 27 the holes 34 are closely flanked by two supporting ribs 31. The holes 34 are aligned respectively with screw necks 38 in the U-profile 25 and are provided to accommodate screws 39 for fixing one of the cover sections 3 as shown in FIG. 2.

A section of the cover section 3 is shown in FIG. 4 in an enlarged perspective view. The two legs 4, 5 of the cover section 3 are connected to one another by a short strengthening plate 40. On the outer surface of the leg 4, turned toward the observer in FIG. 4, depressions 41 are stamped at regular intervals, one of which may be seen cut in FIG. 4. The depressions 41 are stamped into the leg 4, wherein the material of the leg 4 is intersected along the vertical edges of the depressions 41 and the connection to the leg 4 is left in place only along the upper and lower edges of each depression 41. The cutting of the material along the vertical edges permits the depressions 41 to be made deep but narrow, which is sufficient for the head of the screw 39, particularly if it is a countersunk screw, to be completely accommodated.

The projections on the inner surface of the leg 4 corresponding to the depressions 41 engage into the groove 33 of the plastic profile element 27 in the mounted state. The depressions 41 and the groove 33 are positioned on the cover section 3 and the profile element respectively so that, if a rib 8 protruding inward from the leg 4 touches the front edge of the lateral wall of the body 1, the projections engage in the groove 33.

A keyhole-shaped opening 42 is stamped into each depression 41. The opening 42 includes in its lower area a section 43 with a wide diameter, which is sufficient to allow the head of a screw 39 to pass through. An adjoining, narrower section 44 extending vertically upward is only sufficiently wide to accommodate the shaft of the screw 39. It is thus possible initially to affix screws 39 through the holes 34 in the plastic profile element 27 into the screw necks 38 of the U-profile 25 and then to hang the cover section 3 onto these. Since the screws 39 maintain clearance as they engage vertically into the openings 42, the cover section 3 can be adjusted to the required height before the screws 39 are tightened.

On a rearward edge the leg 4 has a sloping surface 46 leading to a point 45, wherein the pointed edge 45 as shown in FIG. 2 rests against the plastic profile element 27. This means that, following installation of the cover section 3, the outer surfaces of the body 1 are also free of hard, sharp edges that could scrape along and damage the wall 20 of the furniture niche when the appliance is pushed in.

The invention claimed is:

1. A domestic appliance for installation in a furniture frame, the appliance comprising:

an essentially rectangular body; and a pair of vertical cover sections, each said cover section being fixed in a height adjustable manner to a front vertical edge of the body and dimensioned to extend laterally beyond the vertical edge adjacent the furniture frame, wherein a leg of a section adjacent to a lateral wall of the body has a hole for a fixing screw and a head of the fixing screw is adapted to be accommodated at least partially in a depression surrounding the hole whilst a shaft of the screw extends through the hole, wherein a floor of the depression surrounding the hole is level and contained in a plane that is offset from a plane containing an outer surface of the leg adjacent the depression, and the shaft of the fixing screw is adapted to maintain clearance as it passes through the hole so that the heights of the cover sections are adjustable relative to the body and one another before being fixed to the respective front vertical edge of the body, wherein the floor of the depression surrounding the hole is connected to the leg only at upper and lower edges thereof

2. The domestic appliance of claim 1, wherein the head of the fixing screw is completely accommodated in the depression.

3. The domestic appliance of claim 1, wherein the hole extends vertically.

4. The domestic appliance of claim 1, wherein the hole has a wide section through which the head of the fixing screw passes, and a narrow section through which the head does not pass.

5. The domestic appliance of claim 1, wherein, on the leg of the section adjacent to the lateral wall, a surface runs downward of the body and backward onto the lateral wall of the body between the depression and a rearward edge.

6. The domestic appliance of claim 1, wherein the cover section comprises a rib adjacent to a front surface of the body.

7. The domestic appliance of claim 1, wherein the cover section is thermally insulated from a metallic support structure of the body by a plastic profile element.

8. The domestic appliance of claim 7, wherein each said depression is provided on an outer surface of the cover section and is associated with a projection on the opposite inner surface of the same, and a groove in the plastic profile element accommodating said projection.

9. The domestic appliance of claim 8, wherein the cover section comprises an extruded cover section and wherein the recesses and projections comprise stamped recesses and projections.

10. The domestic appliance of claim 7, wherein the plastic profile element comprises an extruded plastic profile element.

11. The domestic appliance of claim 7, wherein the plastic profile element comprises a base plate and ribs protruding from the base plate toward the support structure or toward the cover section.

12. The domestic appliance of claim 7, wherein the plastic profile element is a component of the body.

13. The domestic appliance of claim 12, wherein the plastic profile element has a groove into which a fixed outer shell of the body is inserted.

14. The domestic appliance of claim 12, wherein a hook of the plastic profile element encompasses the support structure.

15. The domestic appliance of claim 1, wherein a rear vertical edge of the leg includes a sloping surface to facilitate insertion of the domestic appliance in the furniture frame.

16. The domestic appliance of claim 1, wherein the fixing screw extends from the head towards the lateral wall.

17. The domestic appliance of claim 1, wherein the hole comprises an elongated vertical dimension that is longer than a diameter of the shaft and longer than a horizontal width of the hole, and the fixing screw is fasted at an intermediate position of the vertical dimension so that the pair of vertical cover sections are vertically aligned with one another.

18. The domestic appliance of claim 1, wherein the floor of the depression surrounding the hole is offset from the plane containing the outer surface of the leg toward the essentially rectangular body.

19. A domestic appliance for installation in a furniture frame, the appliance comprising:

an essentially rectangular body;

a fixing screw mounted in a side wall of the rectangular body; and a pair of vertical cover sections, each said cover section being fixed in a height adjustable manner to a front vertical edge of the body and dimensioned to extend laterally beyond the vertical edge adjacent the furniture frame, wherein a leg of a section adjacent to a lateral wall of the body has a hole for the fixing screw and a head of the fixing screw is accommodated at least partially in a depression surrounding the hole whilst a shaft of the screw extends through the hole, wherein a floor of the depression surrounding the hole is level and contained in a plane that is offset from a plane containing an outer surface of the leg adjacent the depression, and the shaft of the fixing screw is adapted to maintain clearance as it passes through the hole so that the heights of the cover sections are adjustable relative to the body and one another before being fixed to the respective front vertical edge of the body, wherein the thickness of the leg at the plane containing the hole is offset to protrude from an inner surface of the leg and is mated within a corresponding vertical groove of the body that is configured to allow the vertical cover section to adjust up and down but restrict movement forward and back.

20. The domestic appliance according to claim 19, wherein the floor of the depression surrounding the hole is connected to the leg only at upper and lower edges thereof.

* * * * *

UNITED STATES PATENT AND TRADEMARK OFFICE

CERTIFICATE OF CORRECTION

PATENT NO. : 9,046,298 B2
APPLICATION NO. : 12/498404
DATED : June 2, 2015
INVENTOR(S) : Laible et al.

It is certified that error appears in the above-identified patent and that said Letters Patent is hereby corrected as shown below:

In the Specification

Column 4, line 11 is missing the following paragraph: "A front edging strip 35 is offset from the base plate 28 by a weak point 36. The inner surface of the edging strip 35 which faces away from the observer in Fig. 3 is slightly curved so that, in the mounted state, the front pointed edge 37 of the edging strip rests tightly against the U-profile 26 as shown in Fig. 2."

Signed and Sealed this
Seventeenth Day of November, 2015

Michelle K. Lee

Michelle K. Lee
*Director of the United States Patent and Trademark Office*